United States Patent [19]

Mittanck

[11] Patent Number: 4,655,322

[45] Date of Patent: Apr. 7, 1987

[54] CLAMP FOR SAFETY LEG OF A LADDER, AND LADDER EQUIPPED THEREWITH

[76] Inventor: Leon R. Mittanck, 433 FM 1456, Bellville, Tex. 77418

[21] Appl. No.: 860,420

[22] Filed: Jul. 9, 1986

[51] Int. Cl.[4] ..... E06C 1/20; E06C 7/42; E06C 5/36

[52] U.S. Cl. ..... 182/172; 182/107

[58] Field of Search ..... 182/172, 169, 170, 107, 182/201

[56] References Cited

U.S. PATENT DOCUMENTS

| | | | |
|---|---|---|---|
| 1,676,618 | 7/1928 | Morris | 182/107 |
| 3,012,628 | 12/1961 | Zumbaum | 182/172 |
| 3,508,628 | 4/1970 | Conrad | 182/172 |
| 3,878,917 | 4/1975 | McBride | 182/172 |
| 4,244,446 | 1/1981 | Mair | 182/172 |
| 4,519,477 | 5/1985 | Ralston | 182/172 |

FOREIGN PATENT DOCUMENTS

| | | | |
|---|---|---|---|
| 1351393 | 12/1963 | France | 182/172 |

*Primary Examiner*—Reinaldo P. Machado
*Attorney, Agent, or Firm*—Norman B. Rainer

[57] ABSTRACT

A clamping device is provided for the adjustable attachment of stabilizer legs to a ladder in a manner to prevent lateral movement of the ladder. The clamping device has paired elongated jaws interconnected by a hinge and spring and adapted to slideably engage the legs of the ladder. A spreader rod is pivotably associated with the hinge and has a free end adapted to move in a vertical path. A stabilizer leg is attached to the free end of the spreader rod. When the spreader rod is swung downwardly, it forces the jaws into gripping contact with the leg of the ladder. When the spreader rod is swung upwardly, the jaws open sufficiently to permit sliding movement along the leg of the ladder.

5 Claims, 4 Drawing Figures

CLAMP FOR SAFETY LEG OF A LADDER, AND LADDER EQUIPPED THEREWITH

BACKGROUND OF THE INVENTION

This invention generally relates to ladders having a pair of stabilizer legs which resist lateral swaying or slipping of the ladder, and more particularly concerns novel means of attachment of said stabilizer legs to the ladder.

A commonly used type of ladder is a bipod ladder having a pair of legs of uniform cross-sectional configuration whose interior, facing surfaces support a plurality of equally spaced parallel rungs. The bipod ladder is intended to be leaned against a structure which is intended to be climbed. When properly placed, the ladder is usually relatively stable longitudinally, namely in the vertical plane that bisects the rungs. However, accidents frequently occur because of lateral tipping or slipping movements. Such accidents are particularly likely when the climber is at the top of the ladder.

Considerable attention has been given to the use of lateral buttressing means to stabilize the ladder. Typical buttressing means are disclosed for example in the following U.S. Pat. Nos.: 1,676,618; 3,012,628; 3,508,628; 3,878,917; 4,244,446; and 4,519,477. In most instances the lateral buttressing means or safety legs are straight rigid members adapted to extend from each leg diagonally downward toward the ground and within the general plane of the ladder. The safety leg is generally removably or pivotably attached at its upper extremity to an outer face of one of the legs of the ladder, and provision is sometimes made for attaching said upper extremity at adjustable heights along the legs of the ladder.

It is found however, that prior safety legs usually require extensive modification of the ladder with which they are utilized. In other instances, the safety legs are not easily or securely attachable to the legs of the ladder.

It is accordingly an object of the present invention to provide laterally buttressing safety legs for a bipod ladder.

It is another object of this invention to provide safety legs as in the foregoing object having clamp means facilitating adjustable and secure attachment to the legs of said ladder.

It is a further object of the present invention to provide clamp means of the aforesaid nature which enable said safety legs to have pivotal movement about said clamp within the general plane of the ladder.

It is still another object of this invention to provide clamp means of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a clamp device for engaging the outer face of a leg of a ladder comprising:

(a) paired elongated jaws each comprised of a base panel and an end panel emerging in L-shaped manner from the base panel and extending to a distal extremity having a gripping edge, (b) hinge means pivotably interconnecting said base panels in a manner to dispose said end panels in facing, substantially parallel relationship, thereby defining a clamping region (c) paired elongated spreader brackets associated with said base panels exterior to said clamping region in facing relationship about said hinge means, said spreader brackets having upper extremities defining entrance means centered about said hinge means, and having lower extremities spanned by a coil spring serving to draw said brackets together, (d) rod holding means pivotably associated with said hinge means exterior to said clamping region and between said spreader brackets, (e) a spreader rod pivotably held at one extremity by said rod holding means in a manner permitting swinging motion of its free extremity in a vertical direction and entrance into said entrance means, whereby, (f) when said spreader rod is moved downwardly, it enters said entrance means and bears laterally against said spreader brackets, causing the gripping edges of the end panels of said jaws to anchor upon a ladder leg positioned within said clamping region, and upward movement of the spreader rod out of contact with said spreader brackets permits said coil spring to withdraw said jaws from anchoring engagement with said leg while permitting sliding engagement therewith.

In preferred embodiments of the clamp device, the spreader rod enters said entrance means when the downwardly directed spreader rod forms an angle of less than 90 degrees with respect to said base panels. Each spreader rod will generally be attached to an elongated safety leg that extends axially from the free extremity of the spreader rod and is adapted to be deployed between the ladder and the ground in a diagonal disposition. Accordingly, when each safety leg is swung upwardly in pivoted motion about the clamp device, it may be made to lie in close parallel adjacency to the associated leg of the ladder, representing a storage state of the safety leg. In such storage state of the safety legs, the clamp devices are freely slidable along the leg of the ladder.

When the safety legs are brought downwardly to their deployed state, the clamp devices anchor upon the legs of the ladder.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
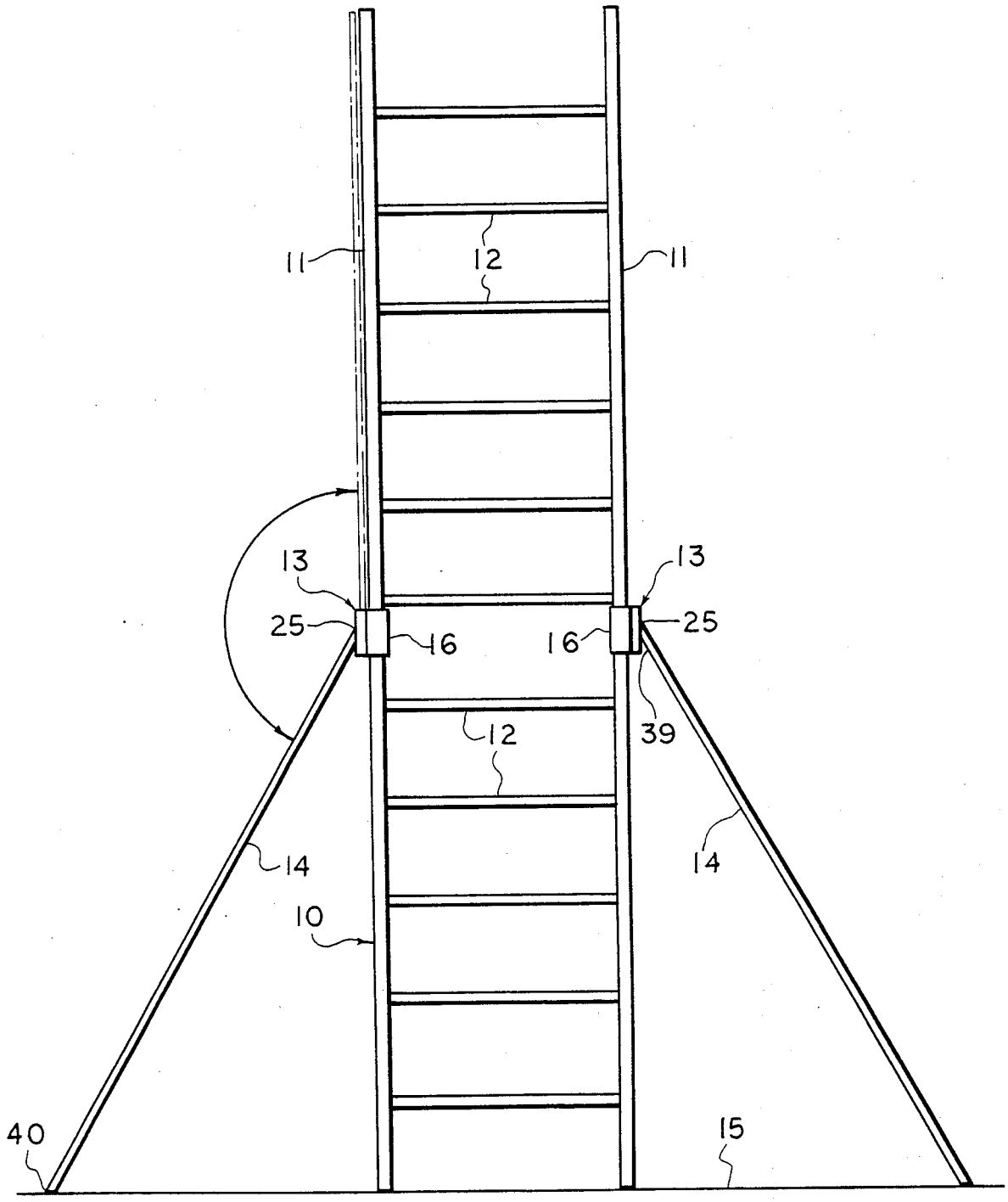
FIG. 1 is a front view of a bipod stepladder equipped with an embodiment of the clamp device and safety legs of the present invention.
Figure 2:
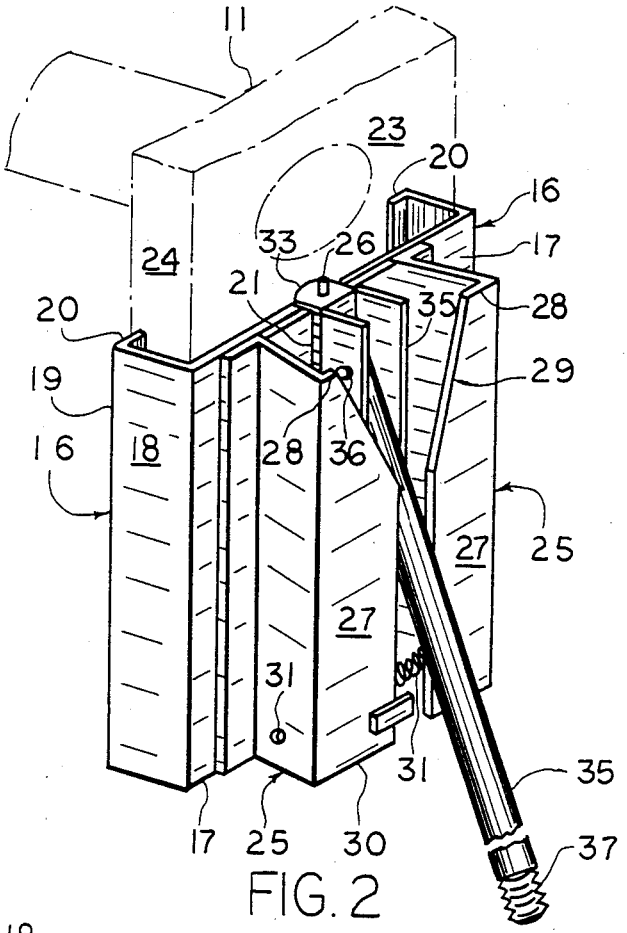
FIG. 2 is an enlarged perspective view of the clamp device of FIG. 1.

Referring to FIG. 1, a bipod stepladder 10 of conventional design is shown comprised of paired parallel legs 11 spanned by a number of equally spaced rungs 12. The legs 11 of the illustrated ladder are of rectangular cross-sectional configuration, as shown in FIG. 2. A clamp device 13 of the present invention slidably engages the exterior face 23 and edges 24 of each leg. A safety leg 14 extends between an upper extremity 39 associated with the clamp device and a lower extremity 40 adapted to engage the surface 15 upon which the ladder is upright positioned. Said lower extremity may be equipped with interchangable gripping means such as resilient and pointed footings for utilization on flat and non-flat surfaces, respectively. The ladder and the safety legs are fabricated of rigid durable material such as wood or metal. The ladder may be further equipped with an extension portion and components associated therewith.

Figure 3:
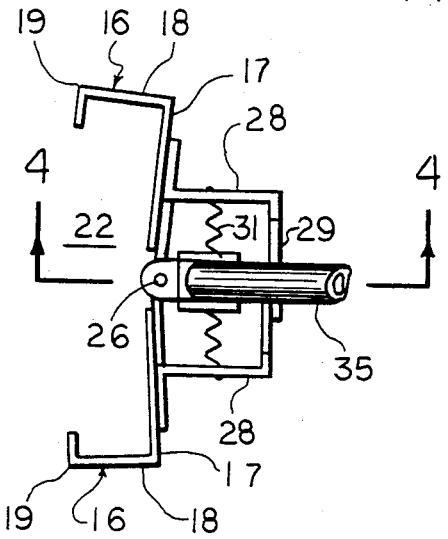
FIG. 3 is a top view of the clamp device of FIG. 2.

As best shown in FIGS. 2 and 3, each clamp is comprised of paired elongated jaws 16, each jaw fabricated from a single piece of sheet metal by cutting and bending operations. Each jaw is comprised of a flat base panel 17 and end panel 18 emerging perpendicularly from base panel 17 as a continuous integral extension thereof and extending to distal extremity 19. A gripping edge 20 is associated with distal extremity 19 in the form of a narrow strip bent back in the direction of base panel 17.

An elongated hinge 21 having an axis rod 26 joins base panels 17 of adjacent jaws in a manner to dispose end panels 18 in facing, substantially parallel relationship. The joined jaws define a clamping region 22 adapted to conform to the exterior face 23 and edges 24 of the leg of the ladder.

Paired elongated spreader brackets 25 are fixedly associated with said base panels exterior to clamping region 22 in facing relationship about axis rod 26 of hinge 21. Each bracket has an abutment shoulder 27 disposed in generally parallel relationship to the corresponding base panel. In the illustrated embodiment, the spreader brackets are integral members fabricated of sheet material and attached to the base panels. In alternative embodiments, the spreader brackets and jaws may be portions of an integral structure fabricated of metal or engineering grade plastic by extrusion or molding methods. The upper extremity 28 of each abutment shoulder is inwardly tapered to form downwardly directed V-shaped entrance means 29 centered about hinge axis rod 26. The lower extremities 30 of the spreader brackets are interconnected by tensioned coil spring 31 serving to draw the brackets together.

Figure 4:
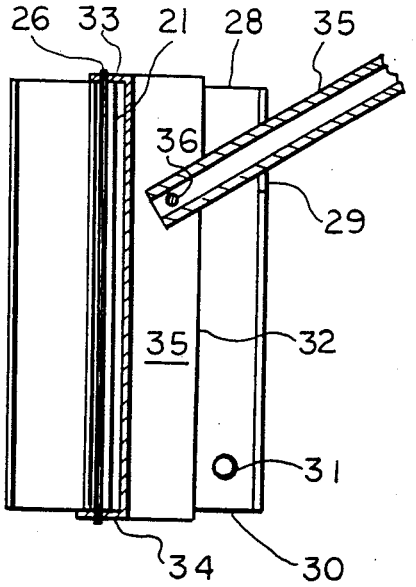
FIG. 4 is a side view of the clamp device of FIG. 2.

As best shown in FIG. 4, rod holding means 32, having a center portion 35 of generally trough-like conformation, is pivotably attached to axis rod 26 by means of upper and lower apertured tabs 33 and 34, respectively which extend from the center portion and fold rearwardly therefrom. The rod holding means is accordingly positioned exteriorly to the clamping region in parallel relationship to hinge 21. It is to be noted that rod holding means 32 is substantially completely confined within the region enclosed by spreader brackets 25.

A spreader rod 35 is held by pivot pin 36 within the center portion 35 of rod holding means 32. Pivot pin 36 is positioned adjacent the lowermost extremity of V-shaped entrance means 29. The free extremity 37 of the spreader rod is provided with external threading to facilitate engagement with a safety leg 14. Other means for attaching the safety leg to the spreader rod may, however, be utilized.

By virtue of the manner of construction of the clamp device, the jaws remain slidably engaged with the ladder leg when the spreader bar and attached safety leg is swung upwardly to the storage state shown in dashed outline in FIG. 1. When the spreader bar and safety legs are swung downwardly, the spreader rod is caused to enter the V-shaped entrance means and ride against abutment shoulders 27. Such action causes the jaws to swing about hinge 21 into anchoring engagement with the ladder leg. With the upper extremity of the safety leg held securely by the clamp, and the lowermost extremity of the safety leg anchored on the ground which supports the ladder, the ladder is stabilized against lateral movement in the general plane of the ladder.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A clamp device for engaging the outer face of a leg of a ladder comprising:

(a) paired elongated jaws each comprised of a base panel and an end panel emerging in L-shaped manner from the base panel and extending to a distal extremity having a gripping edge, (b) hinge means pivotably interconnecting said base panels in a manner to dispose said end panels in facing, substantially parallel relationship, thereby defining a clamping region (c) paired elongated spreader brackets associated with said base panels exterior to said clamping region in facing relationship about said hinge means, said spreader brackets having upper extremities defining entrance means centered about said hinge means, and having lower extremities spanned by a coil spring serving to draw said brackets together, (d) rod holding means pivotably associated with said hinge means exterior to said clamping region and between said spreader brackets, (e) a spreader rod pivotably held at one extremity by said rod holding means in a manner permitting swinging motion of its free extremity in a vertical direction and entrance into said entrance means, whereby, (f) when said spreader rod is moved downwardly, it enters said entrance means and bears laterally against said spreader brackets, causing the gripping edges of the end panels of said jaws to anchor upon a ladder leg positioned within said clamping region, and upward movement of the spreader rod out of contact with said spreader brackets permits said coil spring to withdraw said jaws from anchoring engagement with said leg while permitting sliding engagement therewith.

2. The clamp device of claim 1 wherein the spreader rod enters said entrance means when the downwardly directed spreader rod forms an angle of less than 90 degrees with respect to said base panels.

3. The combination of a clamp device of claim 1 with an elongated safety leg extending axially from the free extremity of said spreader rod.

4. The clamp device of claim 3 wherein the safety leg may be swung upwardly in pivoted motion about the clamp device and thereby made to lie in close parallel adjacency to the associated leg of the ladder.

5. A ladder comprised of a pair of legs of uniform cross-sectional configuration whose interior facing surfaces support a plurality of equally spaced parallel rungs, and whose outer faces each slidably support a combination device of claim 3.

* * * * *